United States Patent [19]

Greif et al.

[11] Patent Number: 4,496,439

[45] Date of Patent: Jan. 29, 1985

[54] ACIDIC ZINC-PLATING BATH

[75] Inventors: Norbert Greif, Bobenheim; Knut Oppenlaender, Ludwigshafen; Albert Hettche, Hessheim; Christos Vamvakaris, Kallstadt, all of Fed. Rep. of Germany

[73] Assignee: BASF Aktiengesellschaft, Fed. Rep. of Germany

[21] Appl. No.: 565,217

[22] Filed: Dec. 23, 1983

[30] Foreign Application Priority Data

Dec. 29, 1982 [DE] Fed. Rep. of Germany ..... 3248503

[51] Int. Cl.[3] ..... C25D 3/22

[52] U.S. Cl. ..... 204/55 R

[58] Field of Search ..... 204/55 R, 43 Z, 114

[56] References Cited

U.S. PATENT DOCUMENTS 3,787,296 1/1974 Hayashida et al. ..... 204/55 R

FOREIGN PATENT DOCUMENTS 1149106 4/1969 United Kingdom ..... 204/55 R 1327303 8/1973 United Kingdom ..... 204/55 R

*Primary Examiner*—G. L. Kaplan

*Attorney, Agent, or Firm*—Keil & Weinkauf

[57] ABSTRACT

In an aqueous acidic plating bath for the electrolytic deposition of zinc, which contains conventional conductive salts, brighteners and surfactants, one of the surfactants is a surfactant of the formula I

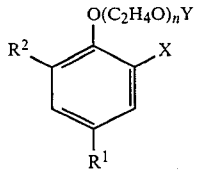

where $R^1$ is $C_4$–$C_{20}$-alkyl, $R^2$ is identical to $R^1$ or is hydrogen, X and Y are each a radical $—SO_3H$, where the hydrogen atom can be replaced by an alkali metal or alkaline earth metal atom or by one equivalent of zinc and n is an integer from 5 to 50.

2 Claims, No Drawings

ACIDIC ZINC-PLATING BATH

The present invention relates to an aqueous acidic zinc-plating bath which contains certain surfactants in addition to the conventional additives, such as conductive salts and brighteners.

The electrolytic deposition of zinc onto metallic substrates from acidic solution, which has become increasingly important over the past few years, is governed by a number of important criteria. Since an acidic solution gives zinc coatings which are generally matt and frequently also irregular, the baths must contain, in addition to conventional conductive salts (for improving the conductivity of the bath), brighteners which increase the brightness of the coatings and which furthermore make it possible to employ a relatively low current density. These brighteners may be assigned to a very large variety of chemical classes and are frequently sparingly soluble or insoluble in water and especially in salt solutions, so that certain surfactants have to be added to the baths; these surfactants act as emulsifiers, producing clear transparent microemulsions. These measures result in a uniform deposit of zinc on the substrate. For these purposes, a number of nonionic surfactants have been employed hitherto, as disclosed in, for example, British Pat. No. 1,149,106. Furthermore, Japanese Preliminary Published Application No. 74/89,637 discloses the use of alkyl-(diphenyl ether)-sulfonic acids; these make it possible to deposit a relatively uniform zinc film, but the ductility is unsatisfactory and, at low current densities, the coatings are not high-hiding.

It is an object of the present invention to provide a class of surfactants which effects good solubilization of the brighteners used and makes it possible, even at low current densities, to obtain uniform and ductile zinc coatings on metallic substrates from acidic zinc-plating baths which contain conventional additives as well as water-insoluble brighteners.

Accordingly, the present invention relates to an aqueous acidic plating bath for the electrolytic deposition of zinc, which contains conductive salts, brighteners and surfactants, wherein one of the surfactants is a surfactant of the formula I

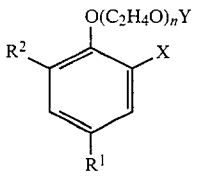

I where $R_1$ is $C_4$–$C_{20}$-alkyl, $R^2$ is identical to $R^1$ or is hydrogen, X and Y are each a radical $—SO_3H$, where the hydrogen atom can be replaced by an alkali metal or alkaline earth metal atom or by one equivalent of zinc and one of the radicals X and Y can be hydrogen, and n is an integer from 5 to 50, and to the use of the compounds of the formula I as surfactants in the stated baths in the presence of brighteners.

In formula I, $R^1$ is preferably $C_4$–$C_{15}$-alkyl. Particularly useful industrially are $C_4$–$C_9$-alkyl radicals, especially butyl, tert.-butyl, octyl and nonyl. $R^2$ may have the same meaning as $R^1$, but is preferably hydrogen. X and Y are each preferably $—SO_3H$, where the hydrogen atom is replaced by sodium or potassium. n is an integer from 5 to 50, preferably from 7 to 30. Where, in the $—SO_3H$ group, H is replaced by zinc, the zinc can also be utilized electrolytically in the bath. Preferably, however, an alkali metal ion, especially the sodium or potassium ion, is chosen as the metal ion.

The surfactants used according to the invention are therefore sulfonated and/or sulfated alkylphenol oxyethylates. They can be used individually or as a mixture with conventional surfactants. Particularly suitable additional conventional surfactants are nonionic ones, such as p-$C_4H_9$- to $C_{12}H_{25}$-alkylphenol oxyethylates containing from 10 to 30 ethylene oxide units, or $\beta$-naphthol oxyethylates containing from 5 to 20 ethylene oxide units. These are advantageously used in an amount of from 1 to 15 g/liter.

The compounds of the formula I are known; those which are unknown can be prepared by a conventional process.

The zinc baths usually contain brighteners, and these can be classified as basic brighteners and high-gloss brighteners. Examples of advantageous basic brighteners are polyethyleneimines or their derivatives. As a rule, the high-gloss brighteners are sparingly soluble or insoluble in the aqueous zinc baths. They include substances from a large variety of classes, in particular certain aromatic and heteroaromatic ketones, as described in, for example, British Pat. No. 1,149,106 and Japanese Preliminary Published Application No. 74/89,637.

Examples of these are compounds of the formula II $$R^3—CH=CH—\overset{\overset{\displaystyle O}{\|}}{C}—R^4, \qquad \text{II}$$

where $R^3$ is an aromatic or heteroaromatic radical, preferably a phenyl or thienyl radical which is unsubstituted or substituted by alkyl, halogen or nitro, and $R^4$ is $C_1$–$C_6$-alkyl, and crude products containing these compounds, and o-chlorobenzaldehyde.

Examples of typical compounds from this class are:

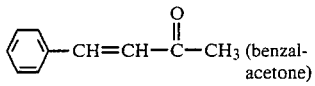

(benzalacetone) Melting range: 39–41° C.

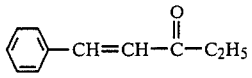

" 39–42° C.

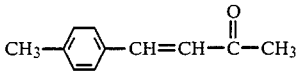

" 34–37° C.

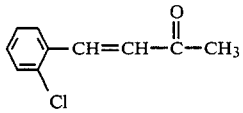

Melting range: 24° C.

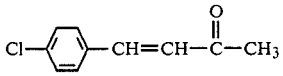

" 51° C.

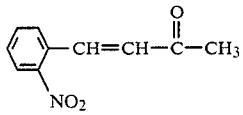

58–59° C.

-continued

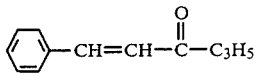

oil

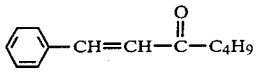

41° C.

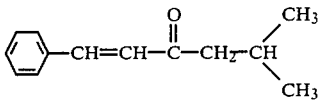

oil

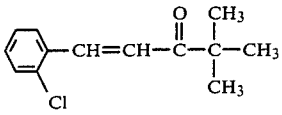

53–55° C.

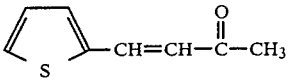

30–35° C.

Among these compounds, benzalacetone is preferred. Furthermore, the brightener used can be o-chlorobenzaldehyde, either alone or as a mixture with a compound of the formula II.

The zinc baths advantageously contain brighteners in a total amount of from 1 to 10 g/liter, and high-gloss brighteners in an amount of from 0.1 to 2.0, preferably from 0.1 to 1, g/liter.

The surfactants used according to the invention are present in the baths in an amount of from 4 to 30, preferably from 5 to 15, g/liter.

Otherwise, the baths have the usual composition. They contain, for example, from 50 to 150 g/liter of zinc chloride or the equivalent amount of zinc sulfate, from 100 to 250 g/liter of potassium chloride (conductive salt), from 15 to 25 g/liter of boric acid and from 1 to 8 g/liter of sodium benzoate, and may contain from 1 to 4 g/liter of an agent for increasing the throwing power, eg. a naphthalenesulfonic acid/formaldehyde condensate. Baths may furthermore contain from 10 to 160 g/liter of ammonium chloride or sodium chloride. The pH of the bath is, as a rule, from 3 to 6.

The novel baths give very bright, ductile zinc coatings over the entire range of current densities.

The Examples which follow illustrate the invention.

EXAMPLES

The properties of the novel surfactants were demonstrated in plating baths having the compositions below. The Example marked with (+), using a compound of the formula I where X and Y are each hydrogen, serves for comparison.

Bath 1:

| | |
|---|---|
| Zinc chloride | 100 g/Liter |
| Potassium chloride | 200 g/Liter |
| Boric acid | 20 g/Liter |
| Sodium benzoate | 2 g/Liter |
| Surfactant according to the invention | 10 g/Liter |
| Naphthalenesulfonic acid/formaldehyde condensate (commercial product) | 2 g/Liter |
| Basic brightner (polyethyleneimine derivative) (commercial product) | 5 g/Liter |
| High-gloss producer (benzalacetone) | 0.4 g/Liter |

Bath 2:

| | |
|---|---|
| Zinc chloride | 86 g/Liter |
| Ammonium chloride | 154 g/Liter |
| Sodium benzoate | 6 g/Liter |
| Basic brightner (polyethyleneimine derivative) | 5 g/Liter |
| Surfactant according to the invention | 15 g/Liter |
| Benzalacetone | 0.4 g/Liter |

Bath 3:

This bath corresponded to Bath 1, except that it contained, in addition to 10 g/liter of the surfactant according to the invention, 5 g/liter of the surfactant of Example 1 in the Table (comparison).

The steel sheets used were plated in a Hull cell for 10 minutes at room temperature (about 23° C.), using 1 Amp.

TABLE 1

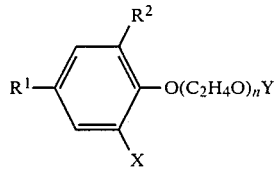

| Example No. | $R^1$ | $R^2$ | X | n | Y | Bath 1 C.T °C. | Bath 1 Brightness | Bath 1 Ductility | Bath 2 C.T. °C. | Bath 2 Brightness | Bath 2 Ductility | Bath 3 C.T. °C. | Bath 3 Brightness | Bath 3 Ductility |
|---|---|---|---|---|---|---|---|---|---|---|---|---|---|---|
| 1 (+) | $C_9H_{19}$ | H | H | 20 | H | 53 | 4 | 5 | 50 | 3 | 2–3 | — | — | — |
| 2 | $C_{12}H_{25}$ | H | $SO_3Na$ | 8 | H | 60 | 4 | 4 | — | — | — | 55 | 4 | 4 |
| 3 | $C_{12}H_{25}$ | H | $SO_3Na$ | 6 | H | 61 | 4 | 5 | 62 | 3–4 | 3 | 58 | 4 | 5 |
| 4 | $C_9H_{19}$ | H | $SO_3Na$ | 16 | H | 71 | 4 | 5 | — | — | — | 68 | 4 | 5 |
| 5 | $C_9H_{19}$ | H | $SO_3Na$ | 10 | H | 68 | 3–4 | 5 | 65 | 3 | 3–4 | 65 | 4 | 5 |
| 6 | $C_4H_9$ | H | $SO_3Na$ | 5 | H | >100 | 3 | 4 | 100 | 3 | 3 | 95 | 3–4 | 4 |
| 7 | $C_4H_9$ | H | $SO_3Na$ | 6 | H | >100 | 3 | 4 | 100 | 3 | 3–4 | >100 | 4 | 5 |
| 8 | $C_8H_{17}$ | H | $SO_3Na$ | 21 | H | 60 | 4–5 | 5 | 60 | 4 | 3 | 58 | 4 | 4 |
| 9 | $C_9H_{19}$ | H | H | 20 | $SO_3Na$ | >100 | 3–4 | 4 | — | — | — | 73 | 4 | 4 |
| 10 | $C_8H_{17}$ | H | H | 25 | $SO_3Na$ | >100 | 4 | 3 | >100 | 4 | 3 | 78 | 4 | 3 |
| 11 | $C_9H_{19}$ | H | $SO_3Na$ | 10 | $SO_3Na$ | >100 | 5 | 5 | >100 | 4 | 3–4 | 85 | 5 | 5 |
| 12 | $C_9H_{19}$ | H | $SO_3Na$ | 20 | $SO_3Na$ | >100 | 5 | 5 | >100 | 4 | 3 | 75 | 4–5 | 4–5 |

C.T. = cloud temperature

1 = poor, 2 = slight, 3 = moderate, 4 = good, 5 = very good

COMPARATIVE EXAMPLE 13

An alkylated diphenyl ether disulfonate (commercial product) was employed in a bath having the same composition as Bath 3. The cloud temperature of the bath for 5 g/liter and 10 g/liter of surfactant was above 100° C.

A steel test sheet was plated in a Hull cell for 10 minutes at room temperature (about 23° C.), using 1 Amp.

In addition to having only slight brightness (Mark 2) and exhibiting a haze, the deposits were found to have very poor ductility (Mark 1). It was impossible to obtain high-hiding coatings at low current densities.

We claim:

1. An aqueous acidic plating bath for the electrolytic deposition of zinc, which contains conductive salts, brighteners and surfactants, wherein one of the surfactants is a surfactant of the formula I

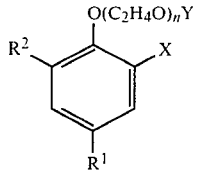

I where $R^1$ is $C_4$–$C_{20}$-alkyl, $R^2$ is identical to $R^1$ or is hydrogen, X and Y are each a radical $—SO_3H$, where the hydrogen atom can be replaced by an alkali metal or alkaline earth metal atom or by one equivalent of zinc and n is an integer from 5 to 50.

2. A bath as claimed in claim 1, which contains a surfactant of the formula I where $R^2$ is hydrogen.

* * * * *